US010436434B2

(12) United States Patent
Boomgaarden

(10) Patent No.: US 10,436,434 B2
(45) Date of Patent: Oct. 8, 2019

(54) GIMBAL LUMINAIRE

(71) Applicant: Lighting Science Group Corporation, Cocoa Beach, FL (US)

(72) Inventor: Mark Penley Boomgaarden, Cary, NC (US)

(73) Assignee: Lighting Science Group Corporation, West Warwick, RI (US)

( * ) Notice: Subject to any disclaimer, the term of this patent is extended or adjusted under 35 U.S.C. 154(b) by 207 days.

(21) Appl. No.: 15/493,182

(22) Filed: Apr. 21, 2017

(65) Prior Publication Data

US 2017/0307185 A1 Oct. 26, 2017

Related U.S. Application Data

(60) Provisional application No. 62/327,856, filed on Apr. 26, 2016.

(51) Int. Cl.

| | |
|---|---|
| ***F21V 17/02*** | (2006.01) |
| ***F21V 29/70*** | (2015.01) |
| ***F21K 9/23*** | (2016.01) |
| ***F21K 9/65*** | (2016.01) |
| *F21K 9/64* | (2016.01) |
| *F21Y 115/10* | (2016.01) |

(52) U.S. Cl.

CPC ..... *F21V 29/70* (2015.01); *F21K 9/23* (2016.08); *F21K 9/65* (2016.08); *F21K 9/64* (2016.08); *F21Y 2115/10* (2016.08)

(58) Field of Classification Search

USPC ..... 362/269

See application file for complete search history.

(56) References Cited

U.S. PATENT DOCUMENTS

| | | | | |
|---|---|---|---|---|
| 2008/0068839 A1* | 3/2008 | Matheson | ..... | F21S 2/005 362/249.07 |
| 2016/0116152 A1* | 4/2016 | Oostdyk | ..... | F21V 29/83 362/84 |

* cited by examiner

*Primary Examiner* — Elmito Breval

(74) *Attorney, Agent, or Firm* — Mark Malek; Paul Ditmyer; Widerman Malek, PL

(57) ABSTRACT

A luminaire comprising a base, a circuitry housing attached to the base and comprising circuitry, a first rotational structure attached to the circuitry housing, a second rotational structure attached to the first rotational structure, and a lighting apparatus attached to the second rotational structure. The circuitry is positioned in electrical communication with each of the base and the lighting apparatus. The first rotational structure is attached to the circuitry housing so as to rotate about a first rotational axis that is parallel to a longitudinal axis of the luminaire. The second rotational structure is attached to the first rotational structure so as to rotate about a second rotational axis that is parallel to a transverse axis of the luminaire.

19 Claims, 6 Drawing Sheets

GIMBAL LUMINAIRE

RELATED APPLICATIONS

This application claims the benefit under 35 U.S.C. § 119(e) of U.S. Provisional Patent Application Ser. No. 62/327,856 filed on Apr. 26, 2016 and titled Gimbal Luminaire, the entire content of which is incorporated herein by reference.

FIELD OF THE INVENTION

The present invention relates to systems for luminaires with rotational capability.

BACKGROUND

The ability to change the direction light is emitted from a single luminaire has been a feature long sought after in the industry. However, the freedom in changing the direction of light has come at either a reduction in the intensity, quality, or beam angle of light emitted thereby, or has enabled only limited freedom. Accordingly, there is a need in the art for a luminaire with improved freedom to change the direction of light emitted thereby while maintaining the quality of light emitted.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a luminaire comprising a base, a circuitry housing attached to the base and comprising circuitry, a first rotational structure attached to the circuitry housing, a second rotational structure attached to the first rotational structure, and a lighting apparatus attached to the second rotational structure. The circuitry may be positioned in electrical communication with each of the base and the lighting apparatus. Additionally, the first rotational structure may be attached to the circuitry housing so as to rotate about a first rotational axis that is parallel to a longitudinal axis of the luminaire. Furthermore, the second rotational structure may be attached to the first rotational structure so as to rotate about a second rotational axis that is parallel to a transverse axis of the luminaire.

In some embodiments, the first rotational structure may be operable to rotate at least 180 degrees about the first rotational axis. In some embodiments, the first rotational structure may comprises a plurality of arms extending generally away from the base and a plurality of hinge connection assemblies. A hinge connection assembly of the plurality of hinge connection assemblies may be positioned at an upper end of each arm. Additionally, each hinge connection assembly of the plurality of hinge connection assemblies may be configured to be attached to the second rotational structure to permit the rotation of the second rotational structure about the second rotational axis. Furthermore, the second rotational structure may comprise a plurality of hinge attachment sections configured to attach to the hinge connection assemblies of the first rotational structure. Also, each hinge connection assembly of the plurality of hinge connection assemblies may be configured to be attached to the second rotational structure to permit the simultaneous rotation of the second rotational structure about the first and second rotational axes.

In some embodiments, the second rotational structure may be attached to the first rotational structure such that each of the second rotational structure and the lighting apparatus rotate about the first rotational axis as the first rotational structure rotates about the first rotational axis. In some embodiments, the second rotational structure may be attached to the first rotational structure such that the second rotational structure may rotate about the second rotational axis independent of the first rotational axis. The second rotational structure may be hemispherical and/or comprise a heat dissipating structure.

In some embodiments, the second rotational structure may comprises a trace recess and a trace positioned within the trace recess. The trace may be positioned in electrical communication with the lighting assembly. Additionally, the trace recess may be positioned along a perimeter of the second rotational structure. Furthermore, the circuitry may be positioned in electrical communication with the trace, thereby establishing electrical communication between the circuitry and the lighting assembly.

In some embodiments, the lighting apparatus may comprise a light source, an optically reflective section, and an optically transmissive section. Additionally, at least one of the light source, the optically reflective section, and the optically transmissive section may comprise a color conversion material.

In some embodiments, the circuitry housing may comprise a plurality of displaceable tangs, each displaceable tang comprising a retaining section and the first rotational structure may comprise a protruding section and a recessed section. The protruding section may be configured to displace the plurality of displaceable tangs as the first rotational structure translates distally along the longitudinal axis of the luminaire with respect to the circuitry housing. Furthermore, the retaining section of the plurality of displaceable tangs may be configured to be positioned within the recessed section and interfere with the protruding section such that the first rotational structure is prevented from translating proximally along the longitudinal axis of the luminaire with respect to the circuitry housing and permitting the first rotational structure to rotate about the first rotational axis with respect to the circuitry housing.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a luminaire with multiple rotational axes. The luminaire may be able to rotate approximately 180° about an axis that is parallel to and/or co-linear with a longitudinal axis of the luminaire. Additionally, the luminaire may be able to rotate approximately 90° about an axis that is parallel to and/or collinear with a transverse axis between two hinge members of the luminaire. Additional information regarding such operation may be found in U.S. patent application Ser. No. 14/087,338 titled Rotatable Lighting Device filed Nov. 22, 2013, the content of which is incorporated herein by reference to the extent disclosure therein is consistent with disclosure herein.

Figure 1:
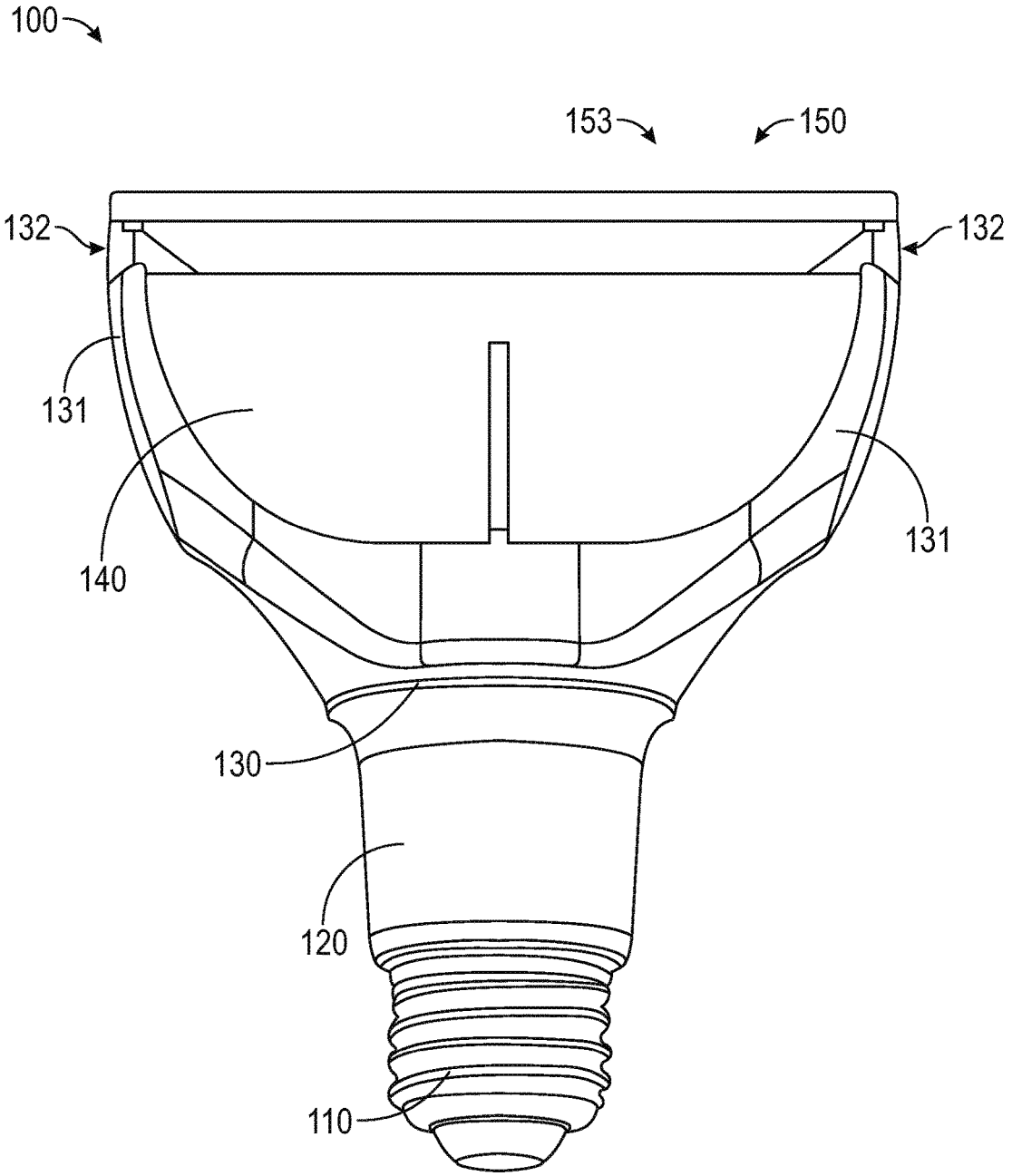
FIG. 1 is a front elevation view of a gimbal luminaire according to an embodiment of the invention.
Figure 2:
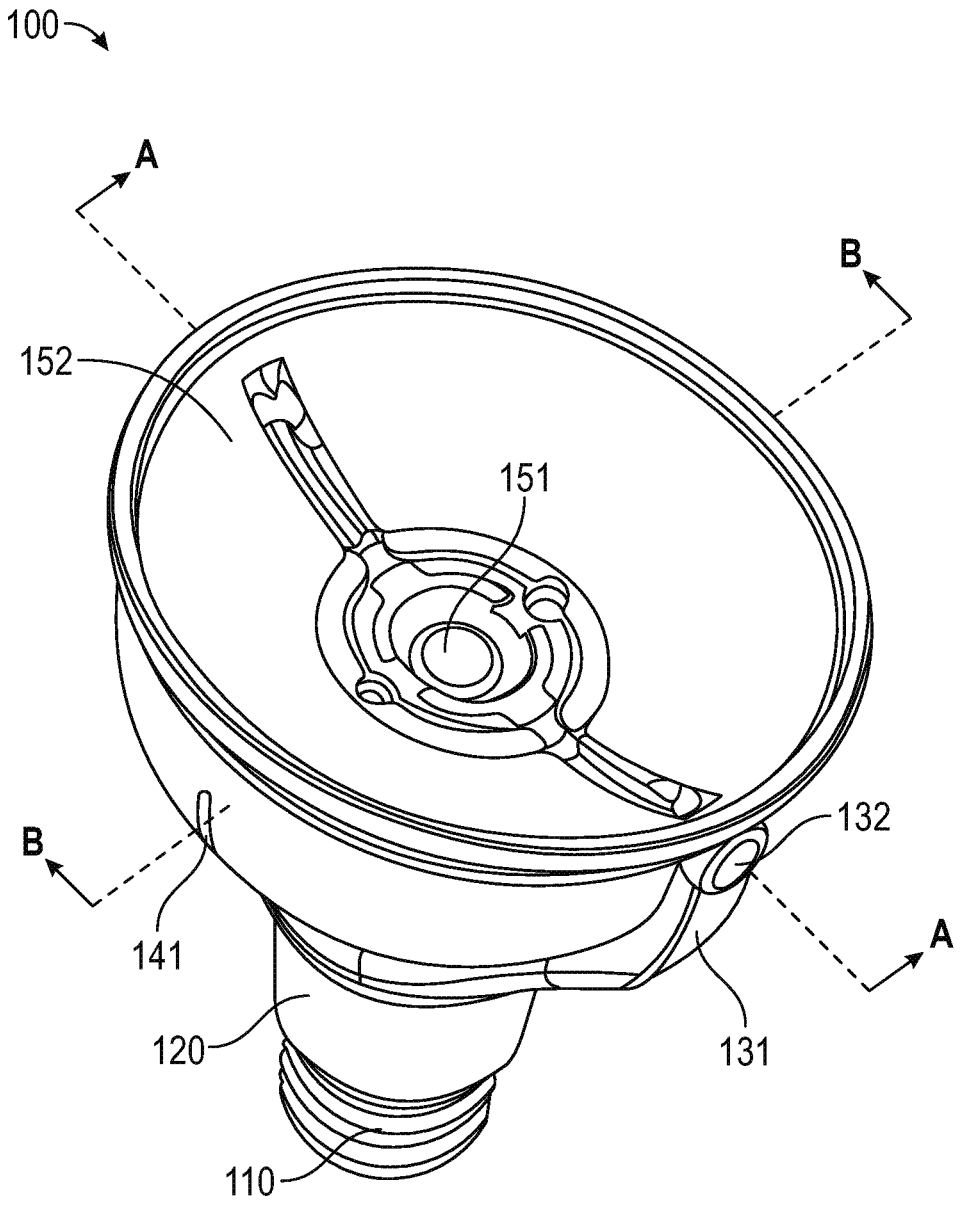
FIG. 2 is a top perspective view of the gimbal luminaire of FIG. 1 with an optically transmissive section thereof removed.
Figure 3:
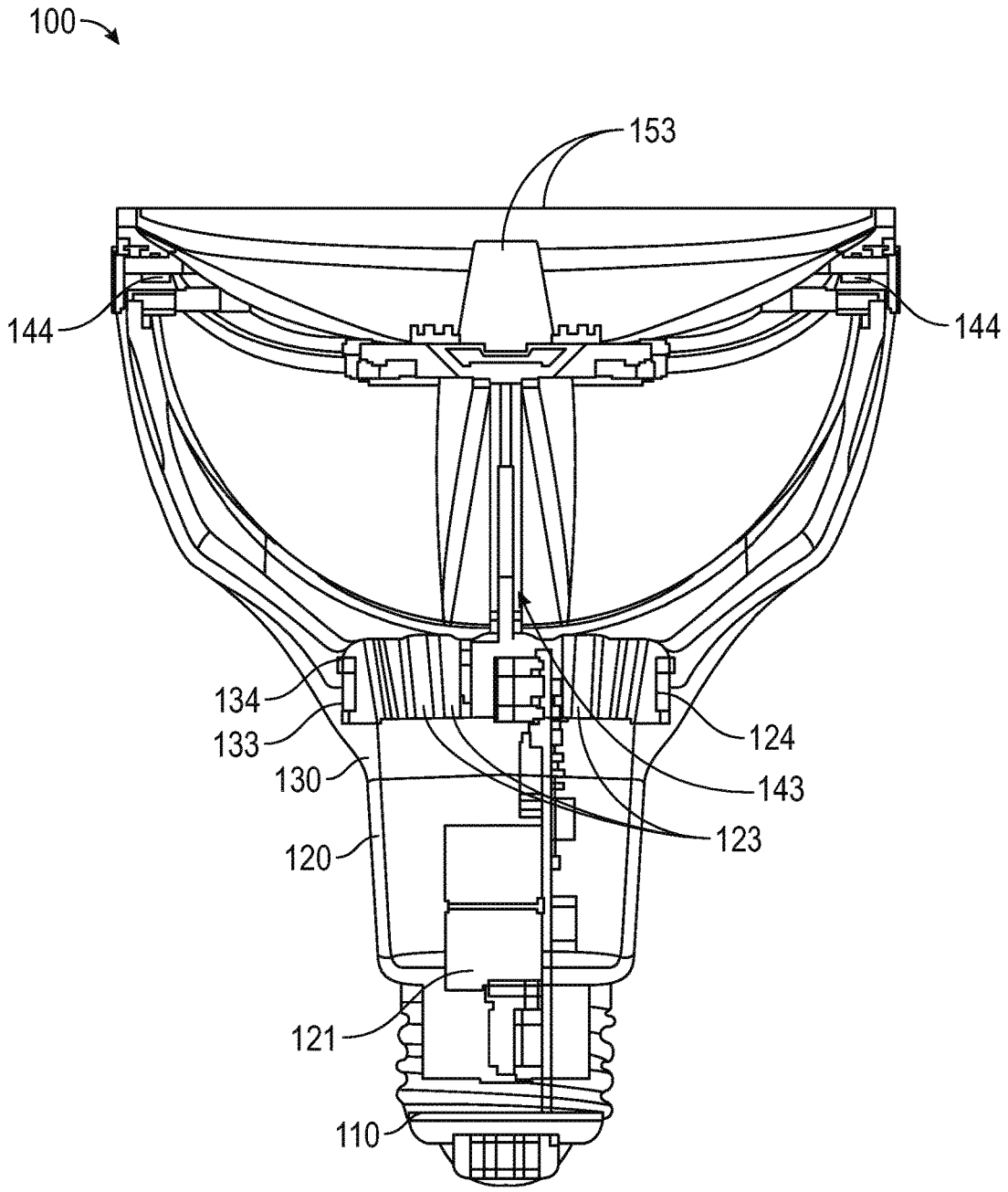
FIG. 3 is a front sectional view of the gimbal luminaire of FIG. 2 taken through line A-A.
Figure 4:
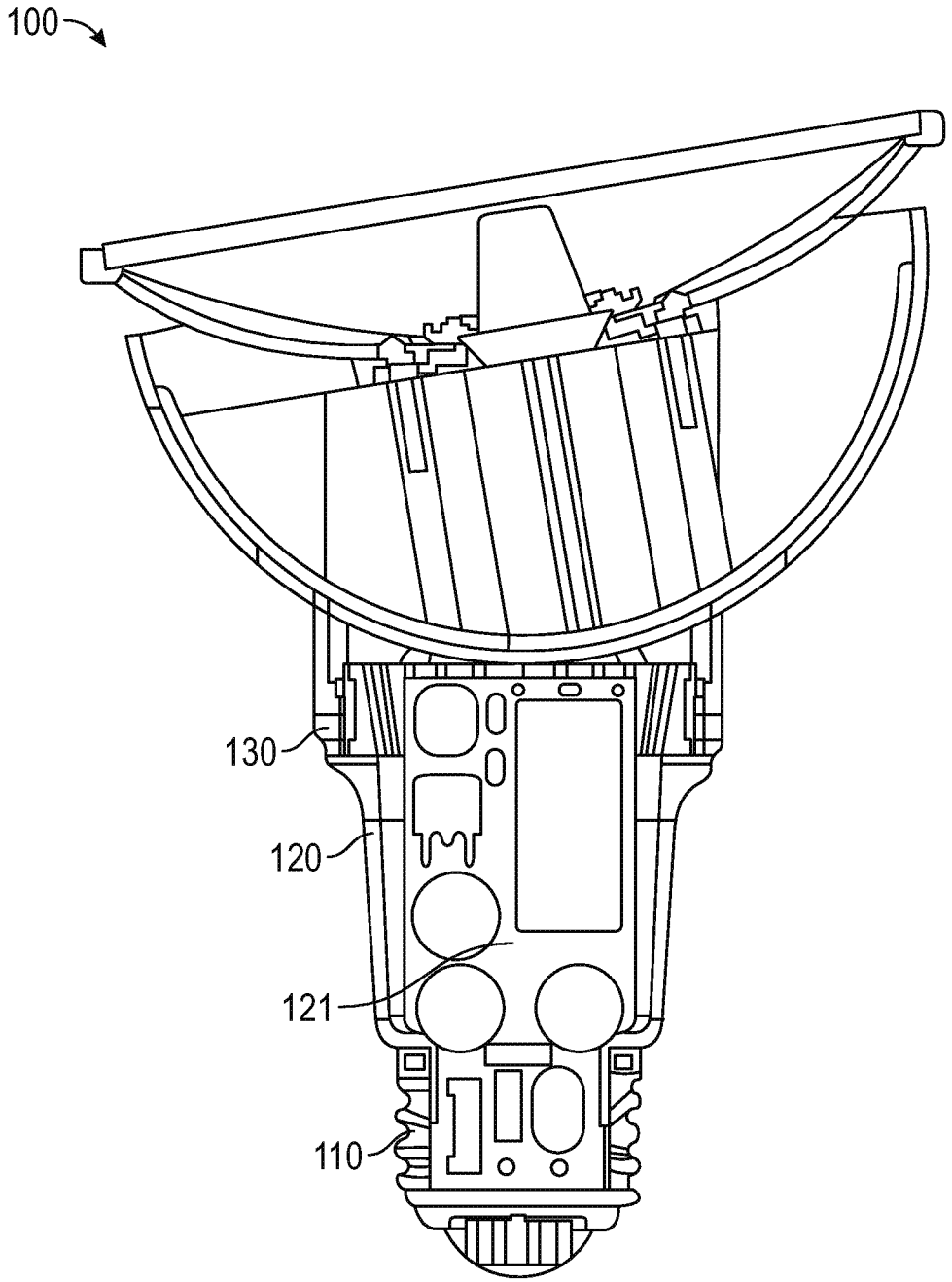
FIG. 4 is a side sectional view of the gimbal luminaire of FIG. 2 taken through line B-B.
Figure 5:
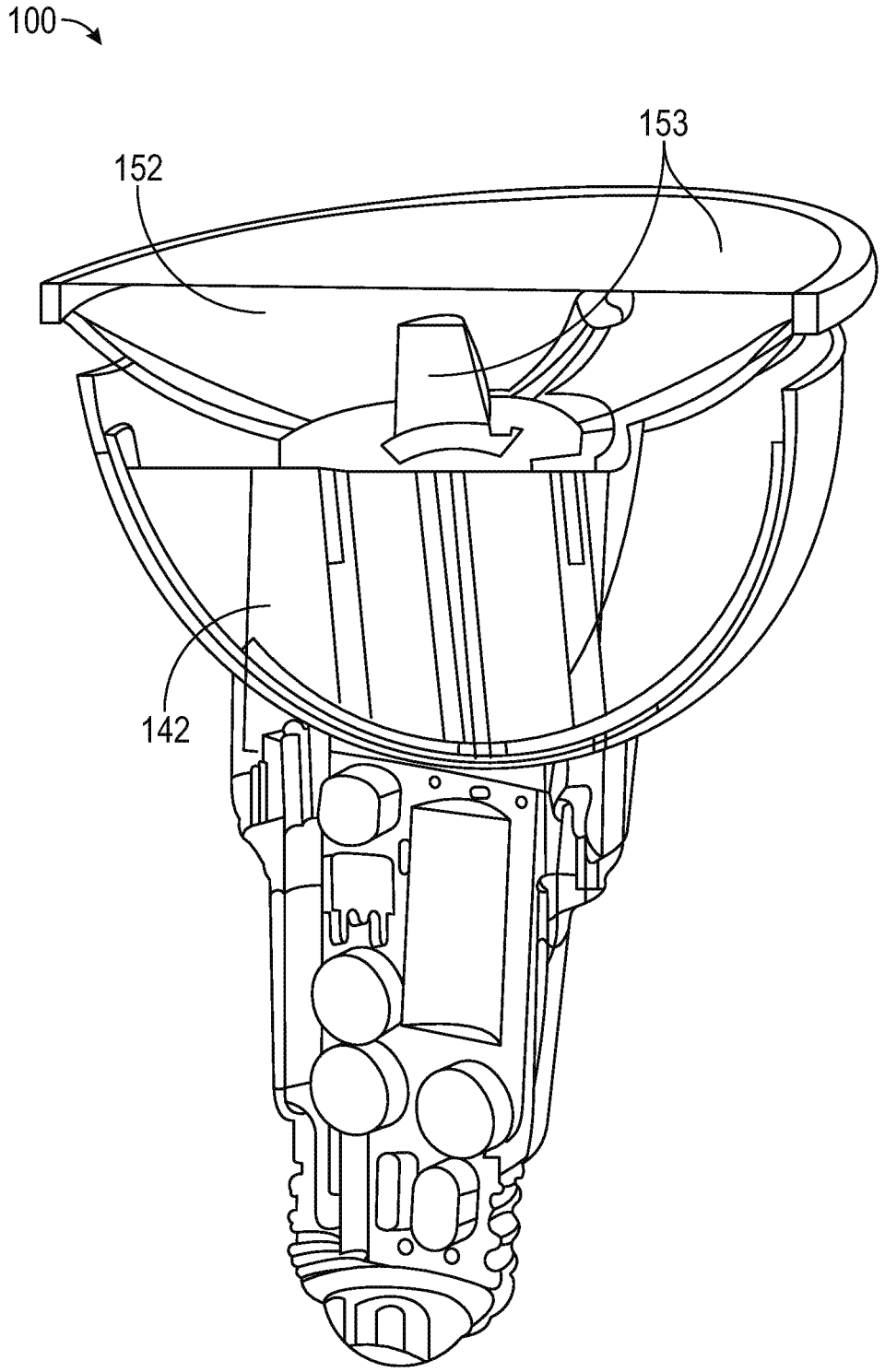
FIG. 5 is an upper perspective sectional view of the gimbal luminaire of FIG. 2 taken through line B-B.
Figure 6:
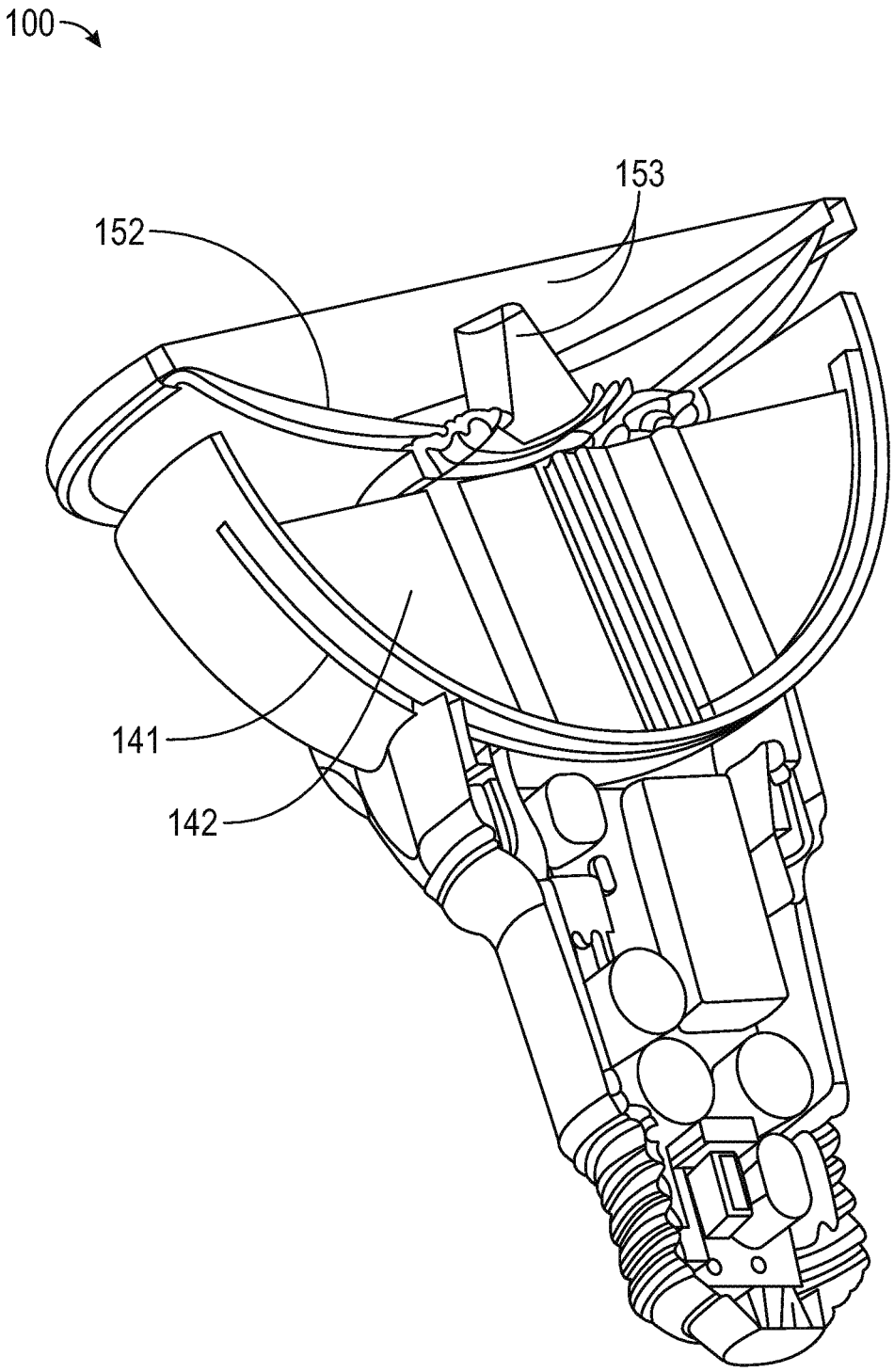
FIG. 6 is a lower perspective sectional view of the gimbal luminaire of FIG. 2 taken through line B-B.

Referring now to FIGS. 1-6, a gimbal luminaire 100 is depicted. The gimbal luminaire 100 may comprise a base 110, a circuitry housing 120, a first rotational structure 130, a second rotational structure 140, and a lighting apparatus 150. The base 110, maybe any type of light bulb base as is known in the art, including, but not limited to, and Edison base, bi-pin base, a wedge base, and the like. The base 110 may be configured to removably attached to and establish electrical communication with a light fixture and/or socket. The base 110 may be configured to be attached to the circuitry housing 120.

Each of the circuitry housing 120 and the first rotational structure 130 may be generally hollow, permitting circuitry 121 to be positioned therethrough. The circuitry 121 may be positioned in electrical communication with the base 110, such that the circuitry 121 may be electrified by a fixture and/or socket to which the base 110 may be connected to.

The first rotational structure 130 may be attached to the circuitry housing 120 such that it may rotate with respect to the circuitry housing 120 about a first rotation axis that is at least one of parallel to and/or collinear with a longitudinal axis of the gimbal luminaire 100. In some embodiments, the first rotational structure 130 may be attached to the circuitry housing 120 such that it may rotate at least about 180° at least one direction about the first rotational axis. Any connection between the first rotational structure 130 and the circuitry housing 120 as is known in the art that can enable such rotation is contemplated and included within the scope of the invention.

In the present embodiment, the circuitry housing 120 may comprise a plurality of displaceable tangs 123. The plurality of displaceable tangs 123 may be positioned towards an upper end of the circuitry housing 120, generally away from the base 110. The plurality of displaceable tangs 123 may be configured to removably couple with a structure of the first rotational structure 130. In the present embodiment, the plurality of displaceable tangs 123 may include a retaining section 124 configured to interface with a structure of the first rotational structure 130 and deter the detachment of the first rotational structure 130 from the circuitry housing 120. Additionally, the first rotational structure 130 may comprise a protruding section 133 and a recessed section 134. The protruding section 133 may be configured to displace the plurality of displaceable tangs 123 radially inward as the first rotational structure 130 is translated in the direction of the base 110, distally along a longitudinal axis of the luminaire 100 with respect to the circuitry housing 120. The retaining section 124 may be configured to be positioned within the recessed section 134 and interfere with the protruding section 133 so as to prevent the first rotational structure 130 from translating proximally along the longitudinal axis of the luminaire 100 with respect to the circuitry housing 120. The interference between the protruding section 133 and the retaining section 124 may be sufficiently small so as to permit the rotation of the first rotational structure 130 about the first rotational axis with respect to the circuitry housing 120.

Additionally, the first rotational structure 130 may comprise a plurality of arms 131 extending generally upward and away from the base 110. At an upper end of each arm 131 the first rotational structure 130 may further comprise a hinge connection assembly 132. The hinge connection assembly 132 may be configured to be attached to the second rotational structure 140 so as to enable the second rotational structure 140 to rotate with respect to the first rotational structure 130. More specifically, the hinge connection assembly 132 may be configured to be attached to the second rotational structure 140 such that the second rotational structure 140 may rotate about a second rotational axis that is generally parallel to and/or collinear with a transverse axis of the gimbal luminaire 100 that may be defined as being between a medial portion of each of the hinge connection assemblies 132, and generally collinear with line A-A. Additionally, the connection between the first and second rotational structures 130, 140 may be such that when the first rotational structure 130 rotates about the first rotational axis, the second rotational structure 140 and the lighting apparatus 150 may also be rotated. When the second rotational structure 140 rotates about the second rotational axis, none of the base 110, circuitry housing 120, or the first rotational structure 130 will rotate.

The second rotational structure 140 may approximately form a hemisphere, and in other embodiments may be other polyhedral shapes, including, but not limited to, spheroids, ellipsoids, ovoids, and the like. The arms 131 may generally circumscribe an outer surface of the second rotational structure 140 thereof.

The second rotational structure 140 may further comprise a trace recess 141 and a trace (not shown) positioned within the trace recess 141. The trace recess 141 May permit the electrical connection between the trace and an electrical connector of the circuitry 121 such that the trace may conduct electricity provided thereto from the circuitry 121. Each of the trace recess 141 and the trace may run along a substantial perimeter of the second rotational structure 140 such that the electrical connection between the trace in the circuitry 121 may be maintained with the rotation of the second rotational structure 140 about the second rotational axis.

The second rotational structure 140 may further comprise a heat dissipating structures 142. The heat dissipating structures 142 may be formed of a thermally conductive material, including, but not limited to, metals, metal alloys, and polymers. The second rotational structure 140 may further comprise a central void 143 that may facilitate the positioning therewithin electrical conductors to establish electrical communication between the trace and electrical components of the lighting apparatus 150.

The second rotational structure 140 may further comprise hinge attachment sections 144 that are configured to attach to the hinge connection assembly 132 of the first rotational structure 130 so as to enable the rotation of the second rotational structure 140 about the second rotational axis. Each of the hinge attachment section 144 and the hinge connection assembly 132 may be any type of hinge, joint, or socket as is known in the art as to enable the rotation described herein.

The lighting apparatus 150 may comprise a light source 151, an optically reflective section 152, and an optically transmissive section 153. The light source 151 may be any type of light emitting device as is known in the art, including, but not limited to, incandescent devices, fluorescent devices, halogen devices, xenon devices, and light-emitting semiconductors, including light-emitting diodes (LEDs). In the present embodiment, the light source 151 may comprise an LED array. Other types of LEDs devices are contemplated, including, but not limited to, LED dies, LED chip-on-board devices, and individual LEDs.

The light source 151 may be positioned so as to emit light generally in the direction of the optically transmissive section 153. The optically transmissive section 153 may be formed of a material that is generally transparent and/or translucent. A portion of the light emitted by the light source 151 may be in the direction of the optically reflective section 152. The optically reflective section 152 may be formed of, and alternatively be coated with, an optically reflective material. The optically reflective section 152 may be formed such that light incident thereupon may be reflected in the direction of the optically transmissive section 153. Additionally, the optically transmissive section 153 may include features and structural characteristics configured to emit light there from away from the gimbal luminaire 100 in a direction generally orthogonal to a surface defined by the light source 151, and in general distributions centered thereabout, including Lambertian distributions and others as are known in the art.

Any and/or all of the light source 151, the optically transmissive section 153, and the optically reflective section 152 may comprise a color conversion material that may convert at least a portion of light having a maximum intensity within a first wavelength range to light within a second wavelength range that is not equal to the first wavelength range.

The lighting apparatus 150 may be carried by the second rotational structure 140. Accordingly, when the second rotational structure 140 rotates about second rotational axis, the entire lighting apparatus 150, and all its comprise components, maybe similarly rotated. Additionally, as the second rotational structure 140 rotates when the first rotational structure 130 rotates about the first rotational axis, the lighting apparatus 150 may be concordantly rotated.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A luminaire comprising:

a base;

a circuitry housing attached to the base and comprising circuitry;

a first rotational structure attached to the circuitry housing;

a second rotational structure attached to the first rotational structure and comprising:

a plurality of arms extending generally away from the base, and a plurality of hinge connection assemblies, wherein a hinge connection assembly of the plurality of hinge connection assemblies is positioned at an upper end of each arm; and wherein each hinge connection assembly of the plurality of hinge connection assemblies is configured to be attached to the second rotational structure to permit the rotation of the second rotational structure about the second rotational axis; and a lighting apparatus attached to the second rotational structure;

wherein the circuitry is positioned in electrical communication with each of the base and the lighting apparatus;

wherein the first rotational structure is attached to the circuitry housing so as to rotate about a first rotational axis that is parallel to a longitudinal axis of the luminaire; and wherein the second rotational structure is attached to the first rotational structure so as to rotate about a second rotational axis that is parallel to a transverse axis of the luminaire.

2. The luminaire according to claim 1 wherein the first rotational structure is operable to rotate at least 180 degrees about the first rotational axis.

3. The luminaire according to claim 1 wherein the second rotational structure comprises a plurality of hinge attachment sections configured to attach to the hinge connection assemblies of the first rotational structure.

4. The luminaire according to claim 1 wherein each hinge connection assembly of the plurality of hinge connection assemblies is configured to be attached to the second rotational structure to permit the simultaneous rotation of the second rotational structure about the first and second rotational axes.

5. The luminaire according to claim 1 wherein the second rotational structure is attached to the first rotational structure such that each of the second rotational structure and the lighting apparatus rotate about the first rotational axis as the first rotational structure rotates about the first rotational axis.

6. The luminaire according to claim 1 wherein the second rotational structure is attached to the first rotational structure such that the second rotational structure may rotate about the second rotational axis independent of the first rotational axis.

7. The luminaire according to claim 1 wherein the second rotational structure is hemispherical.

8. The luminaire according to claim 1 wherein the second rotational structure comprises:

a trace recess; and a trace positioned within the trace recess;

wherein the trace is positioned in electrical communication with the lighting assembly.

9. The luminaire according to claim 8 wherein the trace recess is positioned along a perimeter of the second rotational structure.

10. The luminaire according to claim 9 wherein the circuitry is positioned in electrical communication with the trace, thereby establishing electrical communication between the circuitry and the lighting assembly.

11. The luminaire according to claim 1 where the second rotational structure comprises a heat dissipating structure.

12. The luminaire according to claim 1 wherein the lighting apparatus comprises a light source, an optically reflective section, and an optically transmissive section.

13. The luminaire according to claim 12 wherein at least one of the light source, the optically reflective section, and the optically transmissive section comprise a color conversion material.

14. The luminaire according to claim 1 wherein:

the circuitry housing comprises a plurality of displaceable tangs, each displaceable tang comprising a retaining section;

the first rotational structure comprises a protruding section and a recessed section;

the protruding section is configured to displace the plurality of displaceable tangs as the first rotational structure translates distally along the longitudinal axis of the luminaire with respect to the circuitry housing; and the retaining section of the plurality of displaceable tangs are configured to be positioned within the recessed section and interfere with the protruding section such that the first rotational structure is prevented from translating proximally along the longitudinal axis of the luminaire with respect to the circuitry housing and permitting the first rotational structure to rotate about the first rotational axis with respect to the circuitry housing.

15. A luminaire comprising:

a base;

a circuitry housing attached to the base and comprising circuitry;

a first rotational structure attached to the circuitry housing, comprising:

a plurality of arms extending generally upward, and a plurality of hinge connection assemblies, wherein a hinge connection assembly of the plurality of hinge connection assemblies is positioned at an upper end of each arm;

a second rotational structure attached to the first rotational structure, comprising:

a trace recess, and a trace positioned within the trace recess, wherein the trace is positioned in electrical communication with the lighting assembly a lighting apparatus attached to the second rotational structure;

wherein the circuitry is positioned in electrical communication with each of the base and the lighting apparatus;

wherein the first rotational structure is attached to the circuitry housing so as to rotate about a first rotational axis that is parallel to a longitudinal axis of the luminaire;

wherein the second rotational structure is attached to the first rotational structure so as to rotate about a second rotational axis that is parallel to a transverse axis of the luminaire;

wherein each hinge connection assembly of the plurality of hinge connection assemblies is configured to be attached to the second rotational structure to permit the rotation of the second rotational structure about the second rotational axis; and wherein the circuitry is positioned in electrical communication with the trace, thereby establishing electrical communication between the circuitry and the lighting assembly.

16. The luminaire according to claim 15 wherein the trace recess is positioned along a perimeter of the second rotational structure.

17. The luminaire according to claim 15 where the second rotational structure comprises a heat dissipating structure.

18. The luminaire according to claim 15 wherein the second rotational structure is hemispherical.

19. A luminaire comprising:

a base;

a circuitry housing attached to the base and comprising circuitry;

a first rotational structure attached to the circuitry housing, comprising:

a plurality of arms extending generally upward, and a plurality of hinge connection assemblies, wherein a hinge connection assembly of the plurality of hinge connection assemblies is positioned at an upper end of each arm; and a second rotational structure attached to the first rotational structure and comprising:

a plurality of hinge attachment sections configured to attach to the hinge connection assemblies of the first rotational structure, and a heat dissipating structure; and a lighting apparatus attached to the second rotational structure;

wherein the circuitry is positioned in electrical communication with each of the base and the lighting apparatus;

wherein the first rotational structure is attached to the circuitry housing so as to rotate about a first rotational axis that is parallel to a longitudinal axis of the luminaire;

wherein the second rotational structure is attached to the first rotational structure so as to rotate about a second rotational axis that is parallel to a transverse axis of the luminaire; and wherein each hinge connection assembly of the plurality of hinge connection assemblies is configured to be attached to the second rotational structure to permit the rotation of the second rotational structure about the second rotational axis independent of the first rotational axis.

* * * * *